United States Patent [19]

Machanian

[11] 4,417,496

[45] Nov. 29, 1983

[54] VELOCITY SENSITIVE KEYER CONTROL CIRCUIT FOR AN ELECTRONIC MUSICAL INSTRUMENT

[75] Inventor: William V. Machanian, DeKalb, Ill.

[73] Assignee: The Wurlitzer Company, DeKalb, Ill.

[21] Appl. No.: 273,627

[22] Filed: Jun. 15, 1981

[51] Int. Cl.[3] ..... G10H 1/02

[52] U.S. Cl. ..... 84/1.27; 84/1.26; 84/1.13

[58] Field of Search ..... 84/1.27, 1.24, 1.01, 84/1.03, 1.26, 1.1, 1.13

[56] References Cited

U.S. PATENT DOCUMENTS

| | | | |
|---|---|---|---|
| 4,067,253 | 1/1978 | Wheelwright et al. | 84/1.27 |
| 4,203,337 | 5/1980 | Schwartz et al. | 84/1.01 |
| 4,299,153 | 11/1981 | Hoskinson et al. | 84/1.1 |
| 4,344,347 | 8/1982 | Faulkner | 84/1.26 |

*Primary Examiner*—F. W. Isen

*Attorney, Agent, or Firm*—Trexler, Bushnell & Wolters, Ltd.

[57] ABSTRACT

A touch responsive envelope control system is provided for use in an electronic musical instrument having a multiplexed keyboard, a plurality of assignable tone generators, each being assignable to producing a single note of one or more notes corresponding to one or more actuated keys of the keyboard and a keyer associated with each tone generating means for keying the generated tone with controlled attack time and decay rate and a controllable peak amplitude. The touch responsive system comprises a peak amplitude control system responsive to the actuation of each key for keying the associated tone with a peak amplitude corresponding to the intensity of actuation thereof. The peak amplitude control system includes an encoding circuit responsive to the actuation of each actuated key for producing an encoded intensity signal corresponding to the intensity of actuation thereof and a decoding circuit responsive to each encoded intensity signal for producing a corresponding peak amplitude control signal. An assigning circuit is responsive to the assignment of a given tone generator to production of a note corresponding to an actuated key for assigning the corresponding peak amplitude control signal to the given tone generator for controlling the peak amplitude of the note keyed thereby in accordance with the intensity of actuation of the corresponding key.

16 Claims, 5 Drawing Figures

KEY BOARD SCANNER
CLOCKS
INTENSITY ENCODER
INTENSITY DECODER
ASSIGNMENT
B-2
10
12
14
14a
14b
14c
14d
16
18
20
22
24
26
28
30
32
34
36
38
40
42
44
46
48
50
52
54

A B C
MUX
60
D E F G
M O
14
MUX
64
MUX
62
12
20a
10a
20b

V+
MUX 1
MUX 2
Q D
90a
90b
140
92a
92b

VELOCITY SENSITIVE KEYER CONTROL CIRCUIT FOR AN ELECTRONIC MUSICAL INSTRUMENT

BACKGROUND OF THE INVENTION

This invention relates generally to envelope generation in an electronic musical instrument and more particularly to a system for touch-responsive generation of an envelope waveshape in an electronic musical instrument of the keyboard variety.

In the co-pending application of William R. Hoskinson et al, Ser. No. 065,619, filed Aug. 19, 1979, now U.S. Pat. No. 4,299,153, a touch-responsive envelope control for a keyboard musical instrument is disclosed. The present invention represents an improvement upon this system. Accordingly, the present invention is particularly useful with a tone generator and keyer comprising an LSI circuit of the type disclosed in U.S. Pat. No. 4,203,337 to Schwartz et al. This LSI tone generating and keying circuit or chip will be hereinafter referred to as a B-2 chip, in conformity with its designation in the aforementioned patent.

The present invention, like the aforementioned Hoskinson et al co-pending application is directed to producing an envelope characteristic of a keyed tone approximating the response of a conventional percussion-type instrument such as a piano, in response to the velocity or intensity of the actuation of a key. In this regard, it has been found that the generally exponential charge and discharge characteristics of conventional capacitors provide a suitable approximation of both the attack and decay portions of such an envelope waveshape. However, in conjunction with digital LSI tone generating and keying chips of the type disclosed in the aforementioned Schwartz et al patent, it has heretofore been difficult to provide suitable charging and discharging signals corresponding to a relatively broad range of possible intensities of actuations of a key. Moreover, since as many as 16 separate tone generators and associated keyers may be provided in a typical keyboard instrument, it has heretofore proven difficult to assure the proper association of the charging signals generated in response to each key actuation with only the generator and keyer assigned to the production of the tone corresponding to that key.

In the foregoing Hoskinson et al application one such arrangement is disclosed. However, the present invention makes possible the same accuracy of control, while using fewer and less expensive circuit components. Accordingly, the present invention provides a relatively simpler and more economical system than heretofore available while permitting a broad range of peak intensities of an envelope generated for a particular tone, in accordance with the intensity of actuation of the associated key on the keyboard. Hence, a family of similar attack and decay envelope waveshapes may be provided, each having substantially similar attack time and decay rate, but a peak value to accordance with the intensity of key actuation and hence, a decay time in accordance with this peak value.

OBJECTS AND SUMMARY OF THE INVENTION

Accordingly, it is a general object of the present invention to provide a new and improved touch-responsive envelope control system for an electronic musical instrument.

A related object is to provide such a control system which is simpler and more economical than heretofore proposed systems and yet highly reliable in operation.

Briefly, the present invention provides a peak amplitude control system for an electronic musical instrument having a multiplexed keyboard, a plurality of assignable tone generating means, each being assignable to produce a single note of one or more notes corresponding to one or more actuated keys of said keyboard and keying means associated with each tone generating means for keying the generated tone with controlled attack time and decay rate and a controllable peak amplitude. The peak amplitude control system is responsive to the intensity of actuation of each key for keying the associated tone with a peak amplitude corresponding to said intensity and comprises encoding means responsive to the actuation of each actuated key for producing an encoded intensity signal corresponding to the intensity of actuation thereof, decoding means responsive to each encoded intensity signal for producing a corresponding peak amplitude control signal, and assigning means responsive to the assignment of a given tone generator to production of a note corresponding to an actuated key for assigning the corresponding peak amplitude control signal to said given tone generator for controlling the peak amplitude of the note keyed thereby in accordance with the intensity of actuation of the corresponding key.

BRIEF DESCRIPTION OF THE DRAWINGS

Other objects, features and advantages of the present invention will become more readily apparent upon reading the following detailed description of the illustrated embodiment, together with the accompanying drawings, in which:

FIG. 3 is a schematic circuit diagram of a first portion of the control system of the invention;

DETAILED DESCRIPTION OF THE ILLUSTRATED EMBODIMENT

Figure 1:
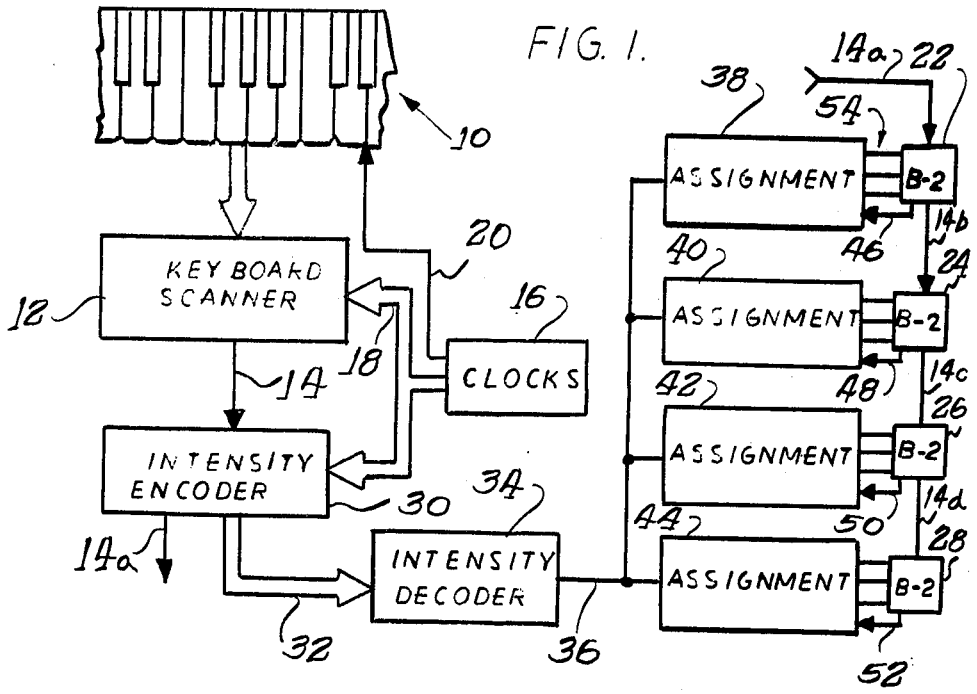
FIG. 1 is a block diagrammatic representation of a control system in accordance with the invention.

Referring now to the drawings and initially to FIG. 1, an electronic instrument includes a keyboard designated generally by the reference numeral 10. This keyboard 10 is scanned and preferably multiplexed by a keyboard scanner or multiplexer 12. As will be seen later with reference to FIG. 2, this multiplexer produces a serial pulse train or data stream on a serial signal line 14 representative of the state of each key of the keyboard 10. In other words, each key of the keyboard 10 is assigned a time slot in a serial data stream generated by the scanner 12. Moreover, the signal occurring in this time slot is indicative of the state of the associated key, either undepressed, fully depressed, or in transition between its undepressed and fully depressed conditions. Suitable clocks 16 are provided for controlling the timing of the operation of the keyboard scanner 12, by way of signal lines 18 and also for providing suitable signals to key busses of the keyboard 10 by way of signal lines 20.

As more fully described in Schwartz et al U.S. Pat. No. 4,203,337, this serial data line 14 is normally fed to a first of a series of tone generator and keyer chips 22, 24, 26 and 28. In the illustrated embodiment the line 14 feeds an intensity encoder circuit 30, which feeds a corresponding serial data stream over a line 14*a* to the chips 22, 24, etc. These tone generator and keyer chips are preferably of the type described in the Schwartz et al patent and designated as B-2 chips. Each of these B-2 chips includes three independent tone generators, each being provided with an associated keyer for keying out the tone generated thereby. Moreover, each of the tone generators on each of these chips is assignable to the production of a single note of one or more notes corresponding to one or more actuated keys of the keyboard 10, in accordance with the corresponding data carried on the serial data line 14*a*. In this regard, the assignment means of these chips are connected substantially in serial fashion by intervening serial data lines 14*b*, 14*c* and 14*d* to accommodate up to twelve notes which may be simultaneously played on the keyboard 10. More or fewer such B-2 chips may be utilized without departing from the invention.

As also described in the above-referenced Schwartz et al patent, each of the keyers associated with the tone generators of the B-2 chips 22–28, inclusive, includes means (not shown) for keying the generated tone with a controlled envelope. Specifically, this envelope control means provides a controlled attack time and decay rate and a controllable peak amplitude, and hence decay time. Each of these envelope control means is therefore responsive to a suitable control signal for determining the peak amplitude and hence decay time of the note keyed thereby.

In accordance with the invention, a control system is provided which produces a suitable control signal to these keyer and envelope control circuits for controlling the peak amplitude of the envelopes generated thereby in accordance with the intensity of actuation of the associated key. To this end, the intensity encoder circuit 30 receives the serial data line 14 from the keyboard scanner or multiplexer 12. This intensity encoder 30 produces a digitally encoded signal corresponding to the intensity of actuation of each key of the keyboard 10, and feeds this digitally encoded signal by way of data lines 32 to an intensity decoder circuit 34. This intensity decoder circuit preferably comprises digital-to-analog conversion circuits for converting the digitally encoded signal on the signal lines 32 into an analog, peak amplitude control signal.

This analog peak amplitude control signal is fed out on a common line 36 to each of four signal assignment circuits 38, 40, 42 and 44, which are respectively associated with the B-2 chips 22, 24, 26 and 28. Each of these signal assignment circuits 38–44, inclusive, is substantially identical, whereby only the first such circuit 38 will be further described. This circuit 38 is responsive to the peak amplitude control signal on the common signal line 36 and to a note assignment signal generated by the B-2 chip 22 (as described in Schwartz et al U.S. Pat. No. 4,203,337) on a line 46 for assigning the peak amplitude control signal to the tone generator selected for generation of the corresponding note. In other words, the intensity control signal and resulting peak amplitude control signal generated in response to a given note is assigned to the keyer associated with the tone generator assigned to reproduction of that note. Each of the assignment circuits 40, 42, 44 functions in the same fashion to assign the peak amplitude control signal from the line 36 to the proper keyer and tone generator in response to a tone generator assignment signal on the associated line 48, 50 or 52. The peak amplitude control signal is then fed out to the selected or assigned keyer by mean of one of three lines designated generally by the reference numeral 54. Hence, each intensity signal or peak amplitude control signal generated on the line 36 will be assigned to one and only one keyer by way of one and only one of the lines 54, in response to the assignment of one and only one tone generator to the production of the corresponding note.

Figure 2:
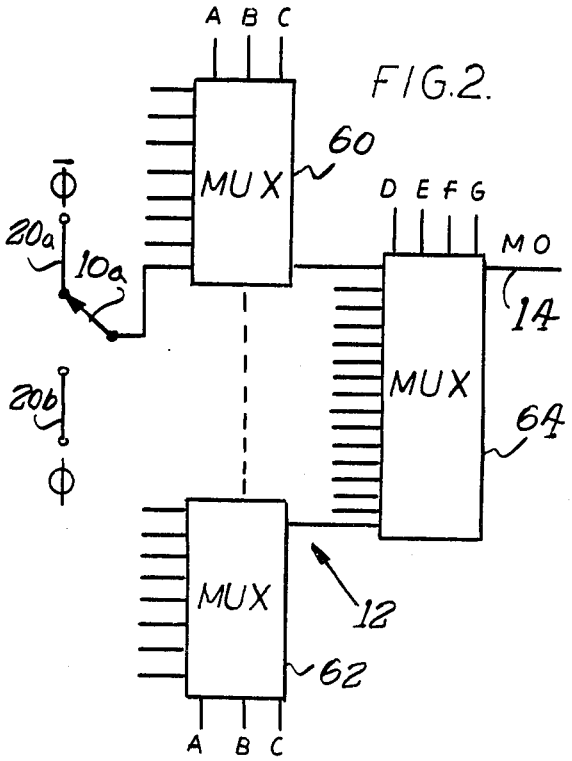
FIG. 2 is a schematic circuit diagram of a multiplexing circuit associated with a keyboard instrument with which the invention may be advantageously utilized.

Referring briefly to FIG. 2, one form of a keyboard scanner or multiplexer system 12 is illustrated in additional detail. Briefly, this scanning or multiplexer system produces a serial data output on the line 14 in which each time slot carries a signal corresponding not only to the identity of a corresponding key of the keyboard 10 but also to the state of that key. In this regard, it will be recognized that each key may be in one of three states: in its undepressed condition, in its fully depressed condition, or in transition between the undepressed and fully depressed conditions. Moreover, it will be recognized that the relative length of time in which the key is in the latter, transition condition, is indicative of the velocity, and hence intensity of actuation of that key.

Accordingly, an upper key bus 20*a* and a lower key bus 20*b* carry suitable clock signals from the clocks 16. Preferably, these signals are inversely related, and hence are here designated as $\phi$ and $\overline{\phi}$. For convenience of illustration a single key 10*a* is here illustrated as a switch movable between the busses 20*a* and 20*b*. This key switch 10*a* forms one input to a first multiplexer 60 which in the illustrated embodiment comprises an 8-bit multiplexer clocked by signals A, B, and C from the clocks 16. Additional such 8-bit multiplexers, clocked by signals A, B, and C, such as multiplexer 62 are also provided. The number of such multiplexers 60, 62 providede depends upon the number of key switches such as the key switch 10*a* associated with the keyboard 10. In other words, a 61-note keyboard, as is provided on many such keyboard instruments, would utilize eight 8-bit multiplexers such as the multiplexers 60 and 62.

The serial signal output of the multiplexers 60 and 62 is fed to a further multiplexer 64, which in the illustrated embodiment is a 16-bit multiplexer clocked by signals D, E, F and G from the clocks 16. Hence, as many as 16 multiplexers 60 and 62 may be accommodated by this multiplexer 64. In a two-manual instrument having two 61-note keyboards, it will be recognized that a total of 16 multiplexers 60 and 62 will be utilized to feed the 16-bit multiplexer 64. Additionally, other functions may be multiplexed by such a system, as for example function switches or tabs of a typical electronic musical instrument such as an organ. The serial data line 14 comprises the serial output of the multiplexer 64.

The clock signals A, B, C, D, E, F and G are preferably of the type described in the above-mentioned co-pending application of William R. Hoskinson et al, Ser. No. 065,619, filed Aug. 19, 1979, and need not be further described herein. Moreover, as described in this co-pending application, the signals $\phi$ and $\overline{\phi}$ on the key busses 20*a* and 20*b* provide a recognizable signal on the serial data line 14, which represents the state of each key of the keyboard 10. However, in the illustrated embodiment, these signals $\phi$ and $\overline{\phi}$ may comprise DC levels such as digital 1 and 0 levels. Hence, a multiplexed output signal (M.O.) on the serial data line 14*a* is in an active or digital 1 state when the key switch such as the key switch 10*a* is in contact with the lower bus 20*b*, and in an inactive or digital 0 state in all other instances.

Reference is next invited to FIG. 3 wherein the intensity encoder circuit 30 is illustrated in detail. This encoder circuit 30 comprises a digital circuit, including a digital read/write memory 70. In the illustrated embodiment this read/write memory 70 comprises a RAM of the type generally designated 2101. This RAM 70 is addressed by the clock signals A, B, C, D, E, F and G, which are the same signals used to clock the multiplexer system of FIG. 2. Hence, the RAM is addressed simultaneously with the multiplexing of the keyboard 10. Accordingly, each data word of the RAM 70 corresponds to a given key of the keyboard 10, and as will be seen later, stores an encoded intensity signal corresponding to the intensity of actuation of the associated key.

The data output or read terminals D01, D02, D03 and D04 of the RAM 70 are coupled respectively to the "A" inputs of a digital adder circuit 72. In the illustrated embodiment this adder 72 is of the type generally designated 4008 and is a 4-bit adder. These same four data outputs of the RAM 70 are also fed through suitable buffer components designated generally by the reference numeral 74 whose outputs QA, QB, QC and QD form the digitally encoded intensity signal lines 32 of FIG. 1.

The carry in input (Ci) of the adder 72 receives from a suitable source a logic "1" positive voltage, while the "B" inputs thereof are all tied to logic "0" or ground. Accordingly, the sum inputs S1, S2, S3 and S4 of the adder 72 produce a 4-bit digital number which comprises the number received from the RAM 70 at the "A" inputs thereof incremented by one least significant bit, due to the +V at the Ci input. This summed output is fed to one input of each of four two-input OR gates designated generally by the reference numeral 76, which in turn feed the D inputs of four D-type flip-flops circuits designated generally by the reference numeral 78. In the illustrated embodiment these D-type flip-flops 80 preferably comprise a single integrated circuit component of the type generally designated 40174 hex D flip-flop. Each of OR gates 76 receives its second or control input from the carry-out (Co) output of the adder 72. The clock terminal (CL) of the flip-flop circuit 78 is fed from the Q1 output of a dual one-shot circuit 80. In the illustrated embodiment this dual one-shot circuit 80 is of the type generally designated 4098. The reset ($\overline{R}$) input of the flip-flop circuit 78 is fed from this same Q1 output of the one-shot 80 by way of an intervening 2-input NAND gate 82. The remaining input of this NAND gate 82 receives the M.O. signal on the serial data line 14 from the multiplexer system of FIG. 2. The Q1, Q2, Q3 and Q4 outputs of the flip-flop circuit 78 feed the data input terminals Di1, Di2, Di3 and Di4 of the RAM 70.

The dual one-shot circuit 80 receives a clock control input signal CL4/4 at its TR1+ trigger input terminal from the clocks 16 of FIG. 1. The $\overline{Q2}$ output of the dual one-shot circuit 80 feeds the read/write ($R/\overline{W}$) control terminal of the RAM 70. The serial data line 14 also feeds the data input (D) of a RS-type flip-flop 84, whose Q output feeds the serial data line 14*a*. The clock input (CL) of this flip-flop 84 receives a clock signal CL2/4 from the clock circuit 16 of FIG. 1.

In operation, the circuit of FIG. 3 functions to produce a series of encoded intensity signals on the outputs 32 which correspond to the intensity of actuation of each key of the keyboard 10. In the illustrated embodiment, the RAM 70 is wired to accommodate 128 4-bit words, which is sufficient to accomodate the keys of two 61-note keyboards. Different numbers of keys may be utilized by modifying the addressing of the RAM 70, without departing from the invention.

The CL4/4 signal in a one-quarter duty cycle signal which is produced by the clock circuit 16 in the last one-quarter of each time slot of the multiplexer system of FIG. 2. Hence, as each key of the keyboard 10 is scanned, a CL4/4 signal is produced during the last quarter of the period during which the associated multiplexing signal 14 is in its high or logic 1 state. Accordingly, a clock signal CL4/4 will be produced to the flip-flop circuit 78 for each scan of each key of the keyboard 10 by the multiplexing system of FIG. 2. If the signal on the serial data line 14 is in the high or active state, indicating that the associated key is in contact with the upper bus 20*a*, the NAND gate 82 will cause the Q1 output from the one-shot 80 to reset the flip-flop 78. Hence, the simultaneously produced Q1 signal to the CL input of the flip-flop 78 will fail to pass the state of the D inputs thereof to the Q outputs thereof which will hence all remain at a low or logic 0 level.

This same CL4/4 signal will also trigger the $\overline{Q2}$ output of the dual one-shot 80 which feeds the read/write terminal of the RAM 70. The RAM 70 will therefore be in the read mode until the CL4/4 signal occurs, whereupon it will be actuated to the write mode by the transition of the $\overline{Q2}$ output. Accordingly, the CL4/4 signal will cause the D inputs of the flip-flop circuit 78 to be fed to the Q outputs thereof and written into the data inputs of the RAM 70 for any key which is not in the fully undepressed condition, i.e., in contact with the upper bus 20*a* during its scan time in the multiplex cycle of the circuit of FIG. 2. If the key is in the fully undepressed condition, four 0 bits will be written into the word in the RAM 70 corresponding to that key.

From the foregoing it will be seen that the adder 72 will increment the 4-bit word read from the RAM 70 for a given key for each scan during which that key remains in an active state, that is, not in contact with the upper bus 20*a*. As mentioned above, the carry-out output (Co) of the adder 72 feeds the remaining input of each of the four OR gates 76. Hence, when the maximum or digital 1111 count is reached by the adder 72 in response to continued depression of a given key over 16 scan periods, this maximum count will be held at the data inputs of the flip-flop 78, rather than rolled over to a 0000 state. Accordingly, a 4-bit binary word having one of 16 possible states will be written into the RAM 70 for each key of the keyboard 10. During each cycle of the keyboard scan the RAM contents for each key will be simultaneously read out on the data lines QA, QB, QC and QD, indicated collectively by the reference numeral 32. It will be noted that tone generator assignment on the B-2 chip does not take place until a key switch contacts the lower bus 20*b*. Accordingly, the 4-bit word on data lines 32 is fully developed by the RAM 70 by the time generator assignment occurs. If a given key remains undepressed, the associated note and RAM contents are not assigned, and are of no consequence. The data lines 32 feed the input of the intensity decoder circuit 34, shown in detail to FIG. 4, to which reference is now invited.

The 4-bit data word on the lines 32 forms the four control inputs to a 16-bit analog multiplexer 90, whose single output forms the line 36 of FIG. 1 which carries the peak amplitude control signal. The 16 analog inputs of the multiplexer are coupled to respective junctions in a voltage divider chain comprising 16 resistors designated generally by the reference numeral 92. These resistors are coupled in series from a suitable positive voltage source +V to ground. In the illustrated embodiment, the resistor values of the resistors 92*b*, 92*c* through 92*n* are selected to logarithmically increase. Accordingly, the divided voltage fed out due to selection of a given junction between resistors logarithmically increases as the selected junction moves from the bottom-most or "15" input of the multiplexer 90 to the topmost or "0" input thereof.

For purposes of disclosing a specific embodiment, the first resistor 92*a* is selected to have a resistance on the order of 3.9 K ohms, which defines a minimum voltage to be fed out on the analog data line 36. The next resistor 92*b* has a value on the order of 200 ohms, while the next series-connected resistor 92*c* has a value of on the order of 220 ohms, the succeeding resistors logarithmically increasing in this fashion. The selected positive voltage +V is on the order of 9 volts DC. Other positive voltage reference potentials and resistor values which increase logarithmically in this fashion may be utilized without departing from the invention.

From the foregoing it will be seen that the 4-digit digital output from the RAM 70 received at the inputs 32 of the multiplexer 90 will bear an inverse relation to the intensity of actuation of the associated key. That is, the less intense the actuation of a given key, the longer period it will take to reach the lower bus 20*b*, and hence the higher count that will accumulate in the RAM 70 for that key. Hence, the resistor values of resistors 92 are arranged in logarithmically increasing fashion to produce a logarithmically decreasing analog voltage signal on the output 36 in response to a binarily increasing digital input signal on the inputs 32 of the multiplexer 90.

The resulting analog peak value control signal is fed through a suitable operational amplifier 94 to the common signal line 36. This common signal line 36 feeds all of the signal assignment circuits 38, 40, 42 and 44. As mentioned above, these four circuits are identical, whereby only the first circuit 38 is here described in detail. The peak amplitude control signal on the line 36 is scaled or adjusted by way of a suitable potentiometer 98 which forms the non-inverting input of an operational amplifier 100 whose inverting input is fed back from the output thereof. The potentiometer 98 associated with each of the intensity control or assignment circuits is provided in order to properly scale the analog voltage on the line 36 for use with that particular circuit and its associated B-2 chip. This allows for normal tolerances in both the B-2 chip and the analog circuit components and provides an offset error adjustment.

The output of the op amp 100 feeds three solid state switches 102, 104 and 106 associated with the three tone generators of the first B-2 chip 22. Three one-shots 108, 110 and 112 are provided to respectively actuate each of these electronic switches 102, 104, 106 in response to a note assignment signal from one of the three tone generators of the B-2 circuit chip 22. Actuation of each of these switches causes the intensity of peak amplitude control signal to be fed to a sample and hold circuit 113 associated with the corresponding tone generator of the B-2 circuit chip 22. These sample and hold circuits 113 are identical, whereby only a first such circuit 113 will be described.

The sample and hold circuit 113 associated with the first tone generator of the circuit chip 22 comprises an operational amplifier (op amp) 114 which is provided with a grounded capacitor 116 at its non-inverting input. The inverting input of the op amp 114 receives feedback from the output thereof which feeds a series-connected resistor 118 and diode 120. The diode 120 feeds an envelope decay control circuit comprising a pair of capacitors 122, 124 and a resistor 126 coupled in parallel to the capacitor 124. The keyer circuit associated with the first tone generator of the circuit chip 22 is coupled to these capacitors 122, 124 and resistor 126 to utilize the discharge or decay voltage thereof as a decay portion of the envelope waveform generated thereby. A further control terminal 128 provides the generator assignment signal associated with the first keyer and tone generator pair of the circuit chip 22 to the one-shot 108 and is also coupled by way of a diode 130 to the capacitor 116. This control terminal 128 also discharges the capacitor 16 when the assigned percussive note has been generated and keyed, so that the generator envelope is percussive with the key closure as in a piano type instrument. In the illustrated embodiment, each of the operational amplifiers 94, 100 and 114 is preferably one operational amplifier component of an integrated circuit component generally designated LF347 quad bi-FET operational amplifier, which has a relatively high impedance and rate of response. In the illustrated embodiment, the generator assignment signal on the line 128 is generated substantially in the middle of a 50 microsecond time slot during which the generator assignment takes place. The one-shot active period is thus somewhat less than this one-half of a 50 microsecond time slot and typically less than on the order of 40 microseconds so that the electronic switch 102 and its associated sample and hold circuit 113 is actuated only long enough to receive the associated peak amplitude control signal. In the illustrated embodiment, the electronic switches 102, 104 and 106 preferably comprise a CMOS switch of either of the types generally designated 4016 and 4066. Additionally, the one-shots 108, 110 and 112 preferably comprise one-shot components of a dual one-shot package of the type generally designated CD4098.

Figure 5:
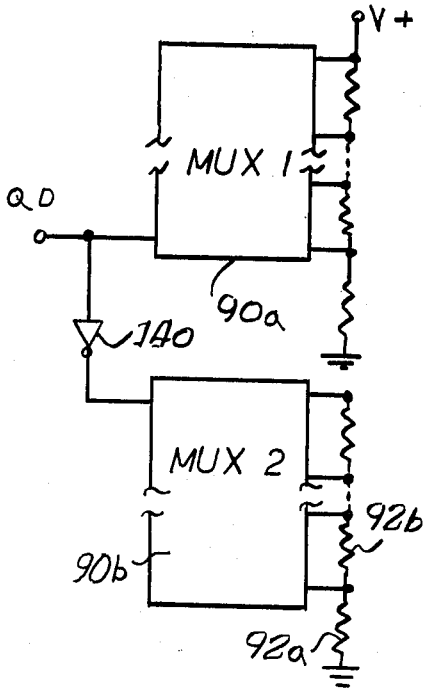
FIG. 5 is a schematic circuit diagram of a circuit useful with a modified embodiment of the circuit of FIG. 4.
Figure 5:
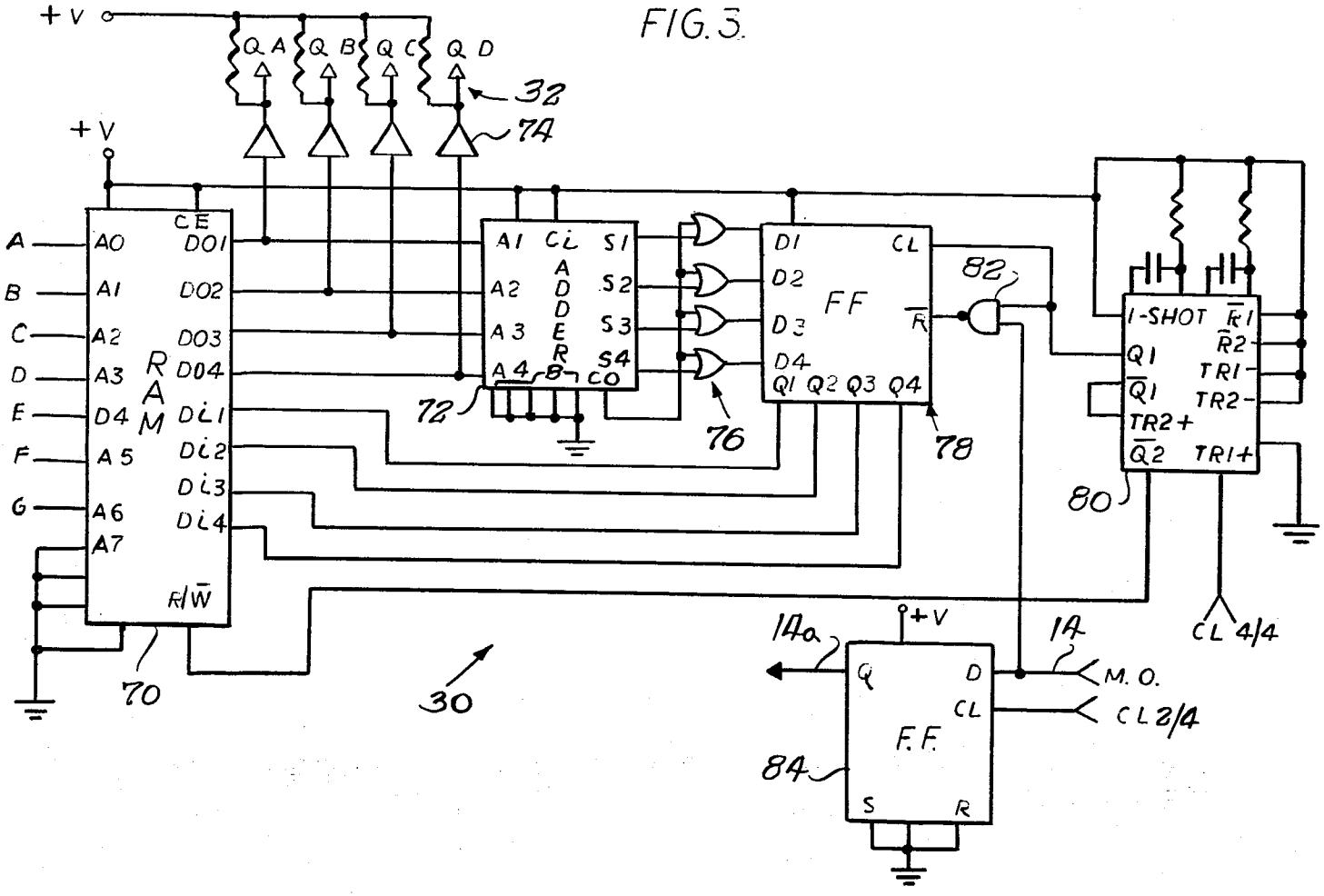
Figure 4:
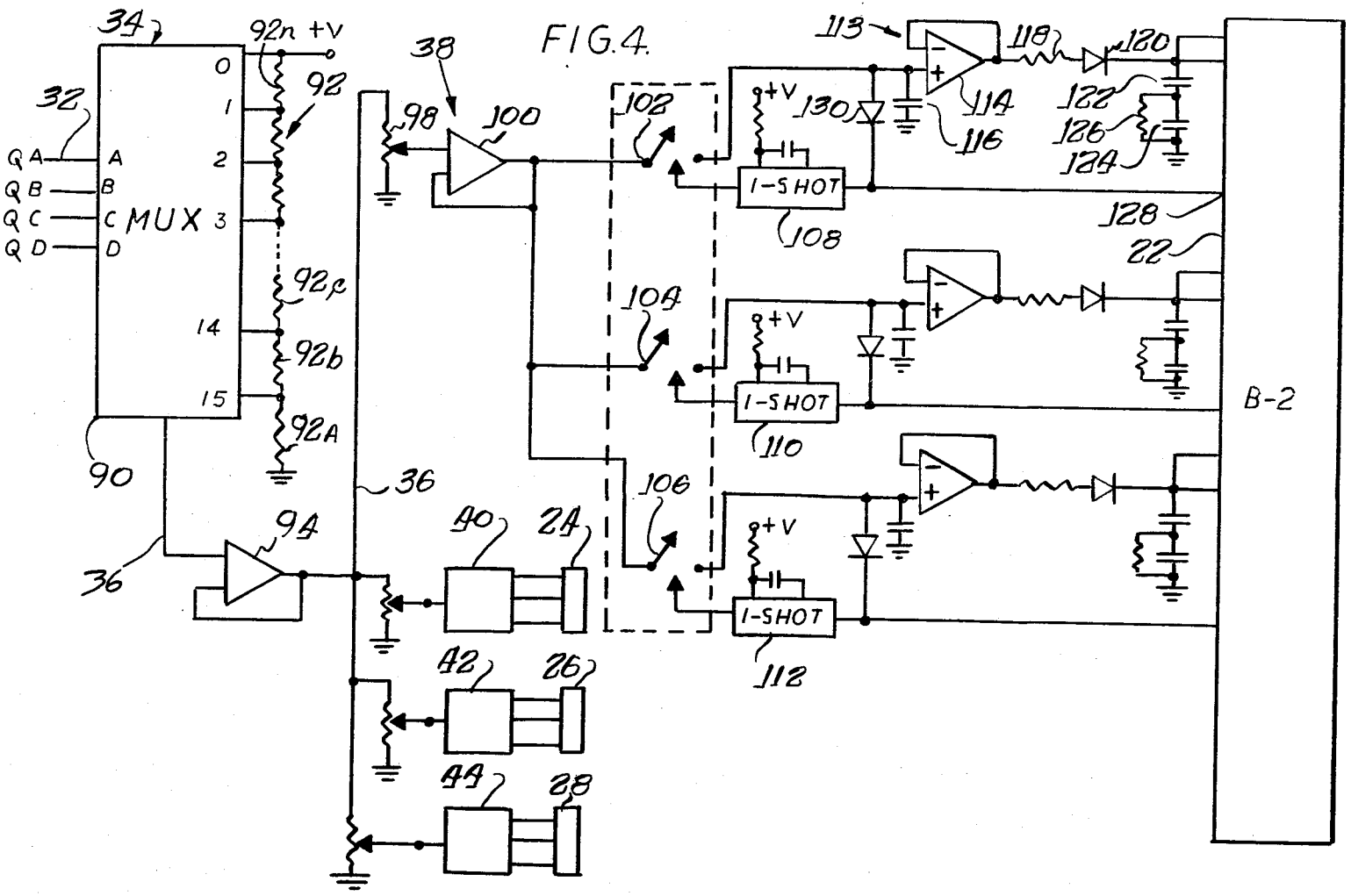
FIG. 4 is a schematic circuit diagram of a second portion of the control circuit in accordance with the invention.

Referring briefly to FIG. 5, the multiplexer 90 may also take the form of a pair of 8-to-1 multiplexers 90*a* and 90*b*, which may be of the type generally designated CD4051. In this case, the QD bit is additionally fed to an inhibit input of the first multiplexer 90*a* and inverted through a suitable buffer inverter 140 to the inhibit input of the multiplexer component 90*b*, to cause these two multiplexers 90*a* and 90*b* to function essentially as a 16-to-1 multiplexer as illustrated in FIG. 4.

What has been illustrated and described herein is a novel and improved intensity or velocity responsive envelope control system for an electronic musical instrument. While the invention has been described with reference to a preferred embodiment, it is not limited thereto. Those skilled in the art may devise various changes, alternatives and modifications upon reading the foregoing descriptions. Accordingly, the invention includes such changes, alternatives and modifications insofar as they fall within the spirit and scope of the appended claims.

The invention is claimed as follows:

1. In an electronic musical instrument having a multiplexed keyboard, a plurality of assignable tone generating means, each being assignable to produce a single note of one or more notes corresponding to one or more actuated keys of said keyboard and keying means associated with each tone generating means for keying the generated tone with controlled attack time and decay rate and a controllable peak amplitude, a peak amplitude control system responsive to the intensity of actuation of each key for keying the associated tone with a peak amplitude corresponding to said intensity and comprising: a single encoding means common to all of the keys of said keyboard and responsive to the intensity of actuation of each actuated key for producing an encoded intensity signal corresponding to said intensity of actuation, a single decoding means common to all of said tone generators and responsive to each encoded intensity signal for producing a corresponding analog peak amplitude control signal, memory means for storing the peak amplitude control signal, gate means connected to said memory means, and assigning means interconnected with said tone generating means and responsive to the assignment of a given tone generator for production of a note corresponding to an actuated key for operating said gate means to gate the corresponding peak amplitude control signal to said given tone generator at the onset of attack for controlling the peak amplitude of the note keyed thereby in accordance with the intensity of actuation of the corresponding key.

2. A control system according to claim 1 wherein said encoding means comprises digital circuit means for producing a digitally encoded signal comprising said encoded intensity signal and corresponding to the intensity of actuation of an actuated key.

3. A control system according to claim 2 wherein said decoding means comprises digital-to-analog circuit means for producing an analog signal comprising said peak amplitude control signal in response to said digitally encoded signal, which analog signal varies logarithmically in accordance with said intensity of actuation of an actuated key.

4. A control system according to claim 2 wherein said memory means receives and stores data corresponding to a plurality of said digitally encoded signals and addressing means for individually addressing data corresponding to each of said digitally encoded signals.

5. A control system according to claim 4 wherein said memory means comprises read/write memory means.

6. In an electronic musical instrument having a multiplexed keyboard, a plurality of assignable tone generating means, each being assignable to produce a single note of one or more notes corresponding to one or more actuated keys of said keyboard and keying means associated with each tone generating means for keying the generated tone with controlled attack time and decay rate and a controllable peak amplitude, a peak amplitude control system responsive to the intensity of actuation of each key for keying the associated tone with a peak amplitude corresponding to said intensity and comprising: a single encoding means common to all of the keys of said keyboard and responsive to the intensity of actuation of each actuated key for producing an encoded intensity signal corresponding to said intensity of actuation, a single decoding means common to all of said tone generators and responsive to each encoded intensity signal for producing a corresponding analog peak amplitude control signal, and assigning means responsive to the assignment of a given tone generator for production of a note corresponding to an actuated key for assigning the corresponding peak amplitude control signal to said given tone generator for controlling the peak amplitude of the note keyed thereby in accordance with the intensity of actuation of the corresponding key, said encoding means comprising digital circuit means for producing a digitally encoded signal comprising said encoded intensity signal and corresponding to the intensity of actuation of an actuated key, said digital circuit means including memory means for receiving and storing data corresponding to a plurality of said digitally encoded signals and addressing means for individually addressing data corresponding to each of said digitally encoded signals, said memory means comprising read/write memory means, said read/write memory means comprising a RAM, and gate means connected to said memory means to gate said peak amplitude control signal to said given tone generator at the onset of attack.

7. A control system according to claim 5 wherein said addressing means comprises multiplexing means which simultaneously multiplexes said keyboard in a predetermined order.

8. In an electronic musical instrument having a multiplexed keyboard, a plurality of assignable tone generating means, each being assignable to produce a single note of one or more notes corresponding to one or more actuated keys of said keyboard and keying means associated with each tone generating means for keying the generated tone with controlled attack time and decay rate and a controllable peak amplitude, a peak amplitude control system responsive to the intensity of actuation of each key for keying the associated tone with a peak amplitude corresponding to said intensity and comprising: a single encoding means common to all of the keys of said keyboard and responsive to the intensity of actuation of each actuated key for producing an encoded intensity signal corresponding to said intensity of actuation, a single decoding means common to all of said tone generators and responsive to each encoded intensity signal of producing a corresponding analog peak amplitude control signal, and assigning means responsive to the assignment of a given tone generator for production of a note corresponding to an actuated key for assigning the corresponding peak amplitude control signal to said given tone generator for controlling the peak amplitude of the note keyed thereby in accordance with the intensity of actuation of the corresponding key, said encoding means comprising digital circuit means for producing a digitally encoded signal comprising said encoded intensity signal and corresponding to the intensity of actuation of an actuated key, said digital circuit means including memory means for receiving and storing data corresponding to a plurality of said digitally encoded signals and addressing means for individually addressing data corresponding to each of said digitally encoded signals, gate means connected to said memory means to gate said peak amplitude control signal to said given tone generator at the onset of attack, said memory means comprising read/write memory means, said read/write memory means further including means responsive to a first clock pulse for reading out the addressed data, and said digital circuit means further including adder means for receiving the data read out from said read/write memory means in response to said first clock pulse and for incrementing said read out data and latch means responsive to a second clock pulse occurring after said first clock pulse for reproducing said incremented data from said adder means, said read/write memory means being responsive to said second clock pulse for receiving and writing said reproduced data from said latch means, said digital circuit means further including clock control means responsive to the actuation of each key for producing said first and second clock pulses, the number of said first and second clock pulses produced thereby corresponding to the intensity of actuation of the corresponding key.

9. A control system according to claim 8 wherein said read/write memory means has a capacity for receiving and storing a number of data words at least as great as the number of keys on said keyboard instrument and is addressed in unison with the multiplexing of said keys for receiving and storing a data word corresponding to the intensity of actuation of each of said keys.

10. A control system according to claim 8 wherein said decoding circuit means comprises analog multiplexer means.

11. A system according to claim 1 wherein said assigning means comprises electronic switch means responsive to the assignment of a tone generating means for passing the peak amplitude control signal to the keyer means associated with the assigned generating means.

12. In an electronic musical instrument having a multiplexed keyboard, a plurality of assignable tone generating means, each being assignable to produce a signal note of one or more notes corresponding to one or more actuated keys of said keyboard and keying means associated with each tone generating means for keying the generated tone with controlled attack time and decay rate and a controllable peak amplitude, a peak amplitude control system responsive to the intensity of actuation of each key for keying the associated tone with a peak amplitude corresponding to said intensity and comprising: a single encoding means common to all of the keys of said keyboard and responsive to the intensity of actuation of each actuated key for producing an encoded intensity signal corresponding to said intensity of actuation, a single decoding means common to all of said generators and responsive to each encoded intensity signal for producing a corresponding peak amplitude control signal, and assigning means responsive to the assignment of a given tone generator for production of a note corresponding to an actuated key for assigning the corresponding peak amplitude control signal to said given tone generator for controlling the peak amplitude of the note keyed thereby in accordance with the intensity of actuation of the corresponding key, said assigning means comprising electronic switch means responsive to the assignment of a tone generating means for passing the peak amplitude control signal to the keyer means associated with the assigned generating means, said assigning means further including one-shot means for actuating said electronic switch means momentarily upon assignment of a tone generating means and sample and hold means interposed between said electronic switch means and the associated keying means for holding said peak amplitude control signal after the momentary actuation of said electronic switch means by said one-shot means.

13. A control system according to claim 12 and further including means for resetting said sample and hold means following keying of said tone produced by the associated tone generator means, so as to be in a condition to receive a further peak amplitude control signal for keying a tone generated by said tone generating means in response to a subsequently assigned actuated key.

14. In an electronic musical instrument having a multiplexed keyboard, a plurality of assignable tone generating means, each being assignable to produce a single note of one or more notes corresponding to one or more actuated keys of said keyboard and keying means associated with each tone generating means for keying the generated tone with controlled attack time and decay rate and a controllable peak amplitude, a peak amplitude control system responsive to the intensity of actuation of each key for keying the associated tone with a peak amplitude corresponding to said intensity and comprising: encoding means responsive to the actuation of each actuated key for producing an encoded intensity signal corresponding to the intensity of actuation thereof, decoding means responsive to each encoded intensity signal for producing a corresponding analog peak amplitude control signal, memory means for storing the peak amplitude control signal, gate means connected to said memory means, and assigning means interconnected with said tone generating means and responsive to the assignment of a given tone generator for production of a note corresponding to an actuated key for operating said gate means to gate the peak amplitude control signal corresponding to that key to said given tone generator at the onset of attack for controlling the peak amplitude of the note keyed thereby in accordance with the intensity of actuation of the corresponding key.

15. A control system according to claim 14 wherein said encoding means comprises digital circuit means for producing a digitally encoded signal comprising said encoded intensity signal and corresponding to the intensity of actuation of an actuated key.

16. A control system according to claim 15 wherein said decoding means comprises digital-to-analog circuit means for producing an analog signal comprising said peak amplitude control signal which varies in accordance with the intensity of actuation of a key.

* * * * *